US009250549B2

(12) United States Patent
Fukuoka et al.

(10) Patent No.: US 9,250,549 B2
(45) Date of Patent: Feb. 2, 2016

(54) FULL-COLOR TONER SET, FULL-COLOR DEVELOPER SET, IMAGE-FORMATION METHOD USING SAME, AND IMAGE-FORMATION DEVICE

(71) Applicant: SHARP KABUSHIKI KAISHA, Osaka-shi, Osaka (JP)

(72) Inventors: Shintaro Fukuoka, Osaka (JP); Tadayuki Sawai, Osaka (JP); Yoritaka Tsubaki, Osaka (JP); Keigo Mitamura, Osaka (JP); Yui Kawano, Osaka (JP); Keiichi Kikawa, Osaka (JP)

(73) Assignee: SHARP KABUSHIKI KAISHA, Osaka-Shi, Osaka (JP)

( * ) Notice: Subject to any disclaimer, the term of this patent is extended or adjusted under 35 U.S.C. 154(b) by 0 days.

(21) Appl. No.: 14/384,435

(22) PCT Filed: Mar. 8, 2013

(86) PCT No.: PCT/JP2013/056509
§ 371 (c)(1),
(2) Date: Sep. 11, 2014

(87) PCT Pub. No.: WO2013/137150
PCT Pub. Date: Sep. 19, 2013

(65) Prior Publication Data

US 2015/0104740 A1 Apr. 16, 2015

(30) Foreign Application Priority Data

Mar. 14, 2012 (JP) ..... 2012-057922

(51) Int. Cl.
*G03G 9/087* (2006.01)
*G03G 9/09* (2006.01)
(Continued)

(52) U.S. Cl.
CPC ..... *G03G 9/09* (2013.01); *G03G 9/0823* (2013.01); *G03G 9/08755* (2013.01);
(Continued)

(58) Field of Classification Search
CPC ..... G03G 9/08711; G03G 9/08755; G03G 9/08782; G03G 9/0906; G03G 9/10
See application file for complete search history.

(56) References Cited

U.S. PATENT DOCUMENTS

2004/0029031 A1* 2/2004 Yamazaki ..... G03G 9/081 430/137.14

FOREIGN PATENT DOCUMENTS

JP 09-127718 5/1997
JP 2000-231219 8/2000
(Continued)

OTHER PUBLICATIONS

Machine English language translation of JP 2005316306, Nov. 10, 2005.*
(Continued)

*Primary Examiner* — Hoa V Le
(74) *Attorney, Agent, or Firm* — Nixon & Vanderhye, P.C.

(57) ABSTRACT

Toners of respective colors of a full-color toner set each contain a binder resin which is polyester resin; and a release agent dispersing aid which is styrene acrylic copolymer resin having at least one of an α-methylstyrene structure and a styrene structure. The styrene acrylic copolymer resin is contained in an amount of 7 parts by weight to 14 parts by weight with respect to 100 parts by weight of the polyester resin. The full-color toner set has a sum of resistivities of the toners of the respective colors of $410\times10^{9}$ to $510\times10^{9}$ (Ω·cm).

4 Claims, 1 Drawing Sheet

(51) Int. Cl.
*G03G 15/01* (2006.01)
*G03G 9/08* (2006.01)

(52) U.S. Cl.
CPC ..... *G03G 9/08782* (2013.01); *G03G 15/01* (2013.01); *G03G 15/0194* (2013.01); *G03G 2215/0141* (2013.01); *G03G 2215/0607* (2013.01)

(56) References Cited

FOREIGN PATENT DOCUMENTS

| | | | |
|---|---|---|---|
| JP | 2002-278157 | 9/2002 | |
| JP | 2003-005432 | 1/2003 | |
| JP | 2003-241434 | 8/2003 | |
| JP | 2003-241435 | 8/2003 | |
| JP | 2003-241436 | 8/2003 | |
| JP | 2005316306 | * 11/2005 | ..... G03G 9/08 |
| JP | 2007-052071 | 3/2007 | |
| JP | 2009-229788 | 10/2009 | |

OTHER PUBLICATIONS

International Search Report for PCT/JP2013/056509, mailed Jun. 11, 2013.

Written Opinion of the ISA (foreign language) PCT/JP2013/056509, mailed Jun. 11, 2013.

* cited by examiner

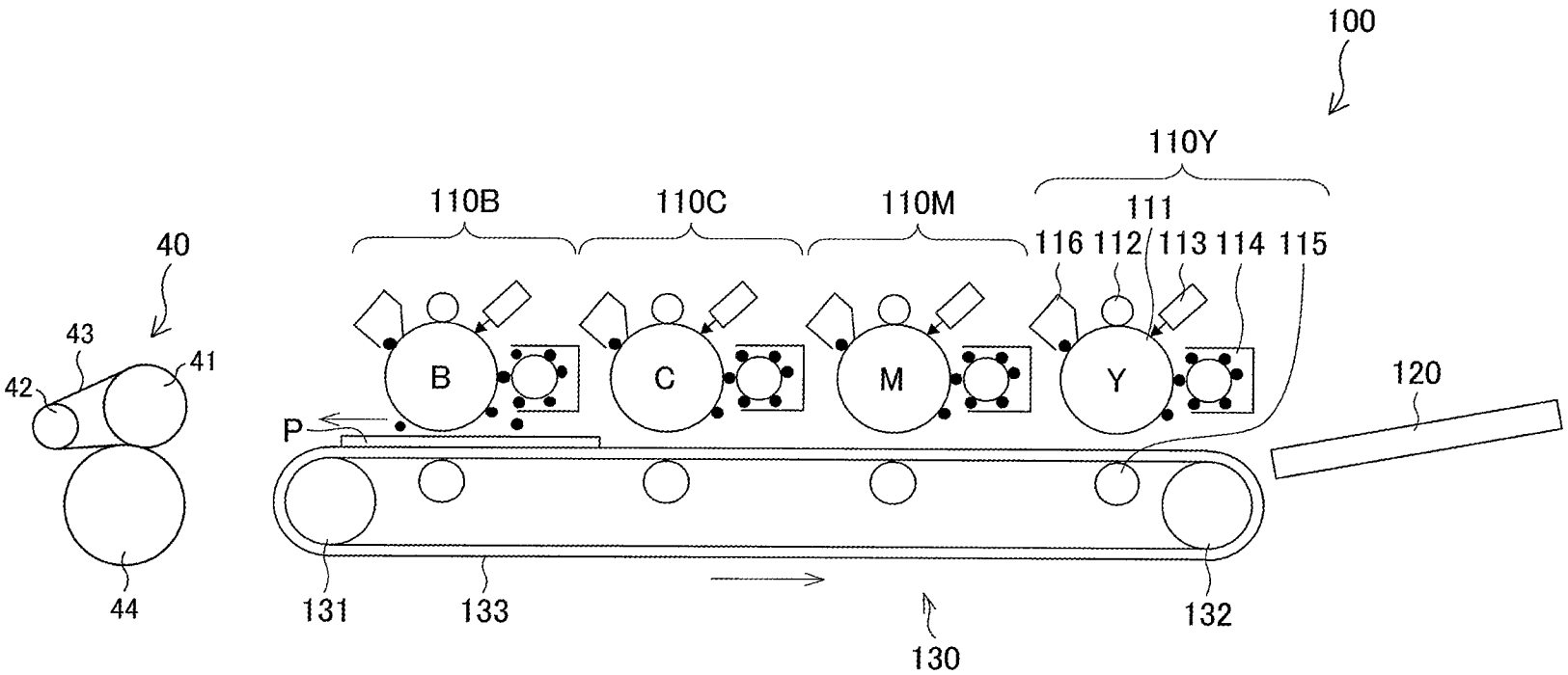
100
110Y
111
112
113
114
115
116
120
Y
110M
M
110C
C
110B
B
P
130
131
132
133
40
41
42
43
44

FULL-COLOR TONER SET, FULL-COLOR DEVELOPER SET, IMAGE-FORMATION METHOD USING SAME, AND IMAGE-FORMATION DEVICE

This application is the U.S. national phase of International Application No. PCT/JP2013/056509 filed 8 Mar. 2013 which designated the U.S. and claims priority to JP Patent Application No. 2012-057922 filed 14 Mar. 2012, the entire contents of each of which are hereby incorporated by reference.

TECHNICAL FIELD

The present invention relates to a full-color toner set and a full-color developer set each of which is supplied to an electrophotographic full-color compatible image forming apparatus, and an image forming method and an image forming apparatus each using the full-color toner set or the full-color developer set.

BACKGROUND ART

Toners of three colors that are cyan, magenta, and yellow are used to form a full-color image, and a black toner may be used in addition to these toners. Generally, since such a full-color image is preferably formed by use of toners which are identical in material other than a coloring agent, there is an idea of a full-color toner set.

For example, Patent Literature 1 discloses a full-color toner set such that toners of cyan, magenta, and yellow each contain polyester resin as a binder resin, a coloring agent, and a grinding aid, and a copolymer resin containing a styrene monomer and an indene monomer is used as the grinding aid. Patent Literature 2 also discloses that the grinding aid is contained in an amount of 1 part by weight to 20 parts by weight, and more preferably of 3 parts by weight to 15 parts by weight, with respect to 100 parts by weight of the binder resin. According to the full-color toner set of Patent Literature 1, the toners of the respective colors can be made identical in grindability.

CITATION LIST

Patent Literatures

Patent Literature 1
Japanese Patent Application Publication, Tokukai, No. 2000-231219 (Publication Date: Aug. 29, 2000)

SUMMARY OF INVENTION

Technical Problem

However, a conventional full-color toner set is not a full-color toner set that has been developed to have an object of stabilizing developing characteristics while satisfying charging characteristics in both a high-temperature and high-humidity (hereinafter referred to as HH) environment and a low-temperature and low-humidity (hereinafter referred to as LL) environment.

The full-color toner set of Patent Literature 1, which full-color toner set is not a full-color toner that has been developed to have the above object, either, does not satisfy charging characteristics in both the HH environment and the LL environment. For example, according to the full-color toner set of Patent Literature 1, the toners of the respective colors each contain the polyester resin as the binder resin. However, the polyester resin has high moisture absorbency, and tends to be vulnerable to the HH environment. The toners having absorbed moisture are less likely to be charged, so that the toners are insufficiently charged in the HH environment. Insufficient charging causes photographic fog.

In a case the HH environment and the LL environment greatly differ in charged amount, developing characteristics change in accordance with a difference in environment, so that photographic fog and toner scattering occur. Toner scattering occurs when charging is too high (overcharging occurs).

An object of the present invention is to provide a full-color toner set and a full-color developer set in each of which developing characteristics are stabilized while charging characteristics are satisfied in both a high-temperature and high-humidity environment and a low-temperature and low-humidity environment and in which photographic fog and toner scattering are less likely to occur, and an image forming method and an image forming apparatus each using the full-color toner set or the full-color developer set.

Solution to Problem

In order to attain the object, a full-color toner set of the present invention contains a cyan toner; a magenta toner; and a yellow toner each containing a binder resin; a coloring agent; a charging control agent; a release agent; and a release agent dispersing aid, the binder resin being polyester resin, the release agent dispersing aid being styrene acrylic copolymer resin having at least one of an α-methylstyrene structure and a styrene structure, the release agent dispersing aid being contained in an amount of 7 parts by weight to 14 parts by weight with respect to 100 parts by weight of the polyester resin, and the full-color toner set having a sum of resistivities of the cyan toner, the magenta toner, and the yellow toner of $410\times10^9$ to $510\times10^9$ (Ω·cm).

The configuration allows a full-color toner set in which developing characteristics can be stabilized while charging characteristics are satisfied in both an HH environment and an LL environment and in which photographic fog and toner scattering are less likely to occur.

The styrene acrylic copolymer resin which is contained as the release agent dispersing aid and has at least one of the α-methylstyrene structure and the styrene structure is present so as to surround the release agent. The release agent and the styrene acrylic copolymer resin surrounding the release agent are integrated during grinding so as to be a large grinding interface. This allows the styrene acrylic copolymer resin to be easily present on a surface of the toner, so that the polyester resin is present on the surface of the toner in a lower ratio. As a result, the toner has lower moisture absorbency in an HH environment. This makes it possible to obtain a sufficient charged amount in the HH environment, so that occurrence of photographic fog is prevented.

Note, however, that in order to obtain such an effect, the styrene acrylic copolymer resin needs to be contained in an amount of not less than 7 parts by weight with respect to 100 parts by weight of the polyester resin. In a case where the styrene acrylic copolymer resin is contained in an amount below the above range, the styrene acrylic copolymer resin is present on the surface of the toner in an insufficient ratio. This causes a reduction in charged amount in the HH environment, so that photographic fog occurs.

Note that the toner has a higher resistivity in a case where the styrene acrylic copolymer resin, which has a higher resistivity than the polyester resin, is contained in a higher ratio.

This results in an increase in sum of the resistivities of the toners of cyan, magenta, and yellow. In a case where the sum of the resistivities is too high, there is a problem such that toner scattering occurs in an LL environment due to a too high charged amount. Further, the resistivities of the toners change in accordance with a resistivity of the polyester resin.

Therefore, it is specified that the sum of the resistivities of the toners of the respective colors falls within a range of $410\times10^9$ to $510\times10^9$ (Ω·cm) and that an upper limit of an amount in which the styrene acrylic copolymer resin is contained with respect to 100 parts by weight of the polyester resin is not more than 14 parts by weight. Such specification as described above allows the amount in which the styrene acrylic copolymer resin is contained with respect to the polyester resin to fall within an appropriate range without being too small or too large. This makes it possible to stabilize developing characteristics while satisfying charging characteristics in both a high-temperature and high-humidity environment and a low-temperature and low-humidity environment.

Advantageous Effects of Invention

The present invention yields an effect of providing a full-color toner set in which developing characteristics are stabilized while charging characteristics are satisfied in both a high-temperature and high-humidity environment and a low-temperature and low-humidity environment and in which photographic fog and toner scattering are less likely to occur.

BRIEF DESCRIPTION OF DRAWINGS

FIG. 1 an explanatory drawing showing an example of configuration of an image forming apparatus in accordance with an embodiment of the present invention.

DESCRIPTION OF EMBODIMENTS

<Image forming apparatus>

FIG. 1 an explanatory drawing showing an example of configuration of an image forming apparatus which uses a full-color toner set (hereinafter abbreviated as a toner set) of the present invention.

An image forming apparatus 100, which is an electrophotographic printer, is a so-called tandem printer including four visible image forming units (a yellow visible image forming unit 110Y, a magenta visible image forming unit 110M, a cyan visible image forming unit 110C, and a black visible image forming unit 110B which are also collectively referred to as "a visible image forming unit 110") which are provided along a recording paper conveying path.

Specifically, four visible image forming units 110 are provided along a conveying path for recording paper P which conveying path is provided between a feeding tray 120 for feeding the recording paper P (a transfer medium, a recording medium) and a fixing device 40. The visible image forming units 110 transfer, to the recording paper P which is carried by a carrying belt 133 being endless and serving as recording paper carrying means 130, toner images of the respective colors so that the toner images overlap each other. Then, a fixing device 40 fixes the toner images to the recording paper P, so that a full-color image is formed.

The carrying belt 133 is provided in a tensioned state by a drive roller 131 and an idle roller 132. The carrying belt 133 circles these rollers while being controlled at a predetermined peripheral velocity (approximately 150 to 400 mm/sec, e.g., 220 mm/sec). The recording paper P is carried by electrostatically adsorbing to the carrying belt 133.

The visible image forming units 110 each include a photoreceptor drum 111, and a charging roller 112, exposure means (laser light irradiation means) 113, a developing device 114, a transfer roller 115, and a cleaner 116 which are provided around the photoreceptor drum 111.

A developer containing a yellow toner of the toner set is contained in the developing device 114 of the visible image forming unit 110Y. A developer containing a magenta toner of the toner set is contained in the developing device 114 of the visible image forming unit 110M. A developer containing a cyan toner of the toner set is contained in the developing device 114 of the visible image forming unit 110C. A developer containing a black toner is contained in the developing device 114 of the visible image forming unit 110B.

Note that the developer may be either a single component developer or a two component developer provided that the developer uses the toner set. Note also that toner contained in the single component developer may be either magnetic or non-magnetic and a carrier contained in the two component developer may be either magnetic or non-magnetic.

A toner image is transferred to the recording paper P in each of the visible image forming units 110. The following discusses how the transfer is carried out. First, a surface of the photoreceptor drum 111 is uniformly charged by the charging roller 112. Thereafter, an electrostatic latent image is formed by causing the laser light irradiation means 113 to expose the surface of the photoreceptor drum 111 to a laser in accordance with image information. Then, the developing device 114 supplies the toner to the electrostatic latent image on the photoreceptor drum 111. According to this, the electrostatic latent image is developed (made visible), so that a toner image is generated. Subsequently, the transfer roller 115 applied with a bias voltage whose polarity is reverse to a polarity of the toner of the toner image sequentially transfers, to the recording paper P which is carried by the carrying belt (carrying means) 130, the toner image generated on the surface of the photoreceptor drum 111.

Thereafter, the recording paper P is detached from the carrying belt 133 at a curved part (part at which the carrying belt 133 is wound on the drive roller 131) and then carried to the fixing device 40. The fixing device 40 includes a heat roller 41, a detachment roller 42, a fixing belt 43 which is endless, is provided in a tensioned state by the heat roller 41 and the detachment roller 42, and is driven to circle these rollers by rotation of the rollers, and a pressure roller 44 which is pressure-joined with the heat roller 41 via the fixing belt 43. The recording paper P is carried to a space between the fixing belt 43 and the pressure roller 44, and a moderate temperature and a moderate pressure are applied to the recording paper P. According to this, the toner of the recording paper P is melted, the toner is fixed to the recording paper P, so that a fast image is formed on the recording paper P. An angle α formed by the recording paper P having passed through a transfer nip and the fixing belt 43 having passed through the transfer nip is a detachment angle.

<Toner>

The following description discusses components of toners of respective colors of a full-color toner set of the present invention.

A full-color toner set of the present invention contains a cyan toner; a magenta toner; and a yellow toner each containing a binder resin; a coloring agent; a charging control agent; a release agent; and a release agent dispersing aid. The binder resin is polyester resin, and the release agent dispersing aid is styrene acrylic copolymer resin having at least one of an α-methylstyrene structure and a styrene structure. The styrene acrylic copolymer resin is contained in an amount of 7 parts by weight to 14 parts by weight with respect to 100 parts by weight of the polyester resin, and the full-color toner set has a sum of resistivities of the cyan toner, the magenta toner, and the yellow toner of $410\times10^9$ to $510\times10^9$ (Ω·cm).

The configuration allows a full-color toner set in which developing characteristics can be stabilized while charging characteristics are satisfied in both an HH environment and an LL environment and in which photographic fog and toner scattering are less likely to occur.

In a case where (i) the styrene acrylic copolymer resin which is contained as the release agent dispersing aid and has at least one of the α-methylstyrene structure and the styrene structure, (ii) the polyester resin, and (iii) the release agent are mixed, the styrene acrylic copolymer resin is present in the polyester resin so as to surround the release agent. This has been confirmed in a TEM photograph.

The release agent and the styrene acrylic copolymer resin surrounding the release agent are integrated during grinding so as to be a large grinding interface. This allows the styrene acrylic copolymer resin to be easily present on a surface of the toner. Therefore, the polyester resin which has moisture absorbency is present on the surface of the toner in a lower ratio, so that the toner has lower moisture absorbency. This makes it possible to obtain a sufficient charged amount in an HH environment, so that occurrence of photographic fog is prevented.

Note, however, that in order to obtain such an effect, the styrene acrylic copolymer resin needs to be contained in an amount of not less than 7 parts by weight with respect to 100 parts by weight of the polyester resin. In a case where the styrene acrylic copolymer resin is contained in an amount below the above range, the styrene acrylic copolymer resin is present on the surface of the toner in an insufficient ratio. This causes a reduction in charged amount in the HH environment, so that photographic fog occurs.

Note that the toner has a higher resistivity in a case where the styrene acrylic copolymer resin, which obtains such an effect as described above and has a higher resistivity than the polyester resin, is contained in a higher ratio. An increase in resistivity of the respective toners inevitably results in an increase in sum of the resistivities of the toners of cyan, magenta, and yellow. However, in a case where the sum of the resistivities is too high, toner scattering occurs in an LL environment due to a too high charged amount. Further, the resistivities of the toners change in accordance with a resistivity of the polyester resin serving as the binder resin, and the polyester resin also varies in resistivity in accordance with a molecular weight, a molecular weight distribution, a kind of a monomer, a kind and an amount of an additive, and oxidation.

Therefore, according to the configuration in which the styrene acrylic copolymer resin is contained, it is specified that the sum of the resistivities of the toners of the respective colors falls within a range of $410\times10^9$ to $510\times10^9$ (Ω·cm) and that an upper limit of an amount in which the styrene acrylic copolymer resin is contained with respect to 100 parts by weight of the polyester resin is not more than 14 parts by weight. Such specification as described above allows the amount in which the styrene acrylic copolymer resin is contained with respect to the polyester resin to fall within an appropriate range without being too small or too large. This makes it possible to stabilize developing characteristics while satisfying charging characteristics in both a high-temperature and high-humidity environment and a low-temperature and low-humidity environment.

The resistivities of the toners of the respective colors can be adjusted by changing a physical property of the polyester resin used mainly as the binder resin. The polyester resin may be obtained by combining polyester resins which differ in resistivity. Alternatively, it is also possible to use polyester resin whose resistance is adjusted to fall within a desired range.

Note that besides the binder resin, the coloring agent, the charging control agent, the release agent, and the release agent dispersing aid, additives such as an electroconductivity adjusting agent, an extender pigment, an antioxidant, a flowability improving agent, a cleaning property improving agent, and the like may also be appropriately contained in each of the toners of the respective colors which toners are contained in the full-color toner set of the present invention.

(Binder Resin)

According to the toners of the respective colors which toners are contained in the full-color toner set of the present invention, the binder resin is polyester resin. Normally, the polyester resin is obtained by a publicly known method by subjecting, to a condensation polymerization reaction, esterification, or transesterification, one or more kind selected from a dihydric alcohol component and a tri- or more hydric polyhydric alcohol component, and one or more kind selected from divalent carboxylic acid and tri- or more valent multivalent carboxylic acid.

It is only necessary that a condition under which the condensation polymerization reaction is carried out be appropriately set in accordance with reactivity of a monomer component and that the reaction be ended when a polymer has a suitable physical property. For example, a reaction temperature is approximately 170° C. to 250° C., and a reaction pressure is approximately 5 mmHg to a normal pressure.

Examples of the dihydric alcohol component include alkylene oxide adducts of bisphenol A such as polyoxypropylene (2.2)-2,2-bis(4-hydroxyphenyl)propane, polyoxypropylene (3.3)-2,2-bis(4-hydroxyphenyl)propane, polyoxypropylene (2.0)-2,2-bis(4-hydroxyphenyl)propane, polyoxypropylene (2.0)-polyoxyethylene(2.0)-2,2-bis(4-hydroxyphenyl) propane, polyoxypropylene(6)-2,2-bis(4-hydroxyphenyl) propane, and the like; diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, and the like; bisphenol A; a propylene adduct of bisphenol A; an ethylene adduct of bisphenol A; hydrogenated bisphenol A; and the like.

Examples of the tri- or more hydric polyhydric alcohol component include sorbitol, 1,2,3,6-hexanetetrol, 1,4-sorbitan, pentaerythritol, dipentaerythritol, tripentaerythritol, sucrose (cane sugar), 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and the like.

The dihydric alcohol components and the tri- or more hydric polyhydric alcohol components can be used alone by one kind or as a combination of two or more kinds in each of the toners of the respective colors.

Examples of the divalent carboxylic acid include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, n-dodecenyl succinic acid, n-dodecyl succinic acid, n-octyl succinic acid, isooctenyl succinic acid, isooctyl succinic acid, and anhydrides or lower alkyl esters of these acids, and the like.

Examples of the tri- or more valent multivalent carboxylic acid include 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxylic-2-methyl-2-methylenecarboxypropane, 1,2,4-cyclohexanetricarboxylic acid, tetra(methylene carboxyl)methane, 1,2,7,8-octanetetracarboxylic acid, pyromellitic acid, Empol trimer acid, and anhydrides or lower alkyl esters of these acids, and the like.

The divalent carboxylic acids and the tri- or more valent multivalent carboxylic acids can be used alone by one kind or as a combination of two or more kinds in each of the toners of the respective colors.

(Coloring Agent)

According to the toners of the respective colors which toners are contained in the full-color toner set of the present invention, the coloring agent for each of cyan, magenta, and yellow is exemplified by, but not particularly limited to a pigment and a dye for toner each of which is commonly used in an electrophotographic field. Examples of the pigment include: organic pigments such as an azo pigment, a benzimidazolone pigment, a quinacridone pigment, a phthalocyanine pigment, an isoindolinone pigment, an isoindoline pigment, a dioxazine pigment, an anthraquinone pigment, a perylene pigment, a perinone pigment, a thioindigo pigment, a quinophthalone pigment, a metal complex pigment, and the like; inorganic pigments such as carbon black, molybdenum red, chrome yellow, titanium yellow, chromium oxide, Berlin blue, and the like; and the like. Examples of the dye include azo dye, anthraquinone dye, chelate dye, squarylium dye, and the like.

The coloring agents may be used alone by one kind, or a plurality of same-colored coloring agents of the coloring agents can be used as a combination of two or more kinds. A contained amount of the coloring agent(s) is not particularly limited. Normally, the coloring agent(s) is/are contained in an amount of 3.0 parts by weight to 9.0 parts by weight with respect to 100 parts by weight of the binder resin.

(Charging Control Agent)

According to the toners of the respective colors which toners are contained in the full-color toner set of the present invention, the charging control agent is not particularly limited, provided that the charging control agent can charge the toner or control the charging of the toner. It is possible to use, as the charging control agent, a charging control agent which is commonly used in the electrophotographic field. Generally, examples of the charging control agent include a boron compound, nigrosine dye, a quaternary ammonium salt, a triphenylmethane derivative, a salicylic acid zinc complex, a naphthol acid zinc complex, a metal oxide of a benzyl acid derivative, and the like. These charging control agents may be used alone by one kind or as a combination of two or more kinds.

A contained amount of the charging control agent is not particularly limited. Normally, the charging control agent is contained in an amount of 0.5 part by weight to 2.0 parts by weight with respect to 100 parts by weight of the binder resin.

(Release Agent)

According to the toners of the respective colors which toners are contained in the full-color toner set of the present invention, the release agent may be any of hydrocarbon wax such as paraffin wax, polyethylene wax, polypropylene wax, polyethylene-polypropylene wax, Fischer-Tropsch wax, microcrystalline wax, or the like, alcohol-modified hydrocarbon wax, ester wax, carnauba wax, amide wax, and the like. However, from the viewpoint of securement of fixability at a low temperature, the release agent having a melting point of 50° C. to 100° C., and preferably of 60° C. to 90° C. is desirable. From the viewpoint of compatibility with the binder resin and releasability, paraffin wax, Fischer-Tropsch wax, ester wax, or carnauba wax is preferable. The release agents may be used alone by one kind or as a combination of two or more kinds.

(Release Agent Dispersing Aid)

According to the toners of the respective colors which toners are contained in the full-color toner set of the present invention, the release agent dispersing aid is styrene acrylic copolymer resin having at least one of an α-methylstyrene structure and a styrene structure.

Specifically, the release agent dispersing aid is a copolymer obtained by combining α-styrene-[$CH_2$—$C(CH_3)(C_6H_5)$]m- or styrene and one kind or two kinds selected from a N-containing vinyl monomer (nitrile), a carboxyl group-containing monomer, an acrylic acid ester monomer (e.g., butyl acrylate), a methacrylate ester monomer (e.g., butyl methacrylate), a methacrylic acid, and the like. The copolymer is not limited to an alternating copolymer.

The release agent dispersing aid is contained in an amount of 7 parts by weight to 14 parts by weight with respect to 100 parts by weight of the polyester resin serving as the binder resin.

<Method for Producing Toner>

The toner of the present invention can be prepared by a grinding process which is preferable in terms of the point that, as compared with a wet process, the grinding process is smaller in number of steps and can be carried out with a smaller amount of capital investment.

The following description discusses a method of the present embodiment for preparing the toner by the grinding process. According to the preparation of the toner, a kneaded product is obtained by blending and melt-kneading toner materials including at least the binder resin, the coloring agent, the release agent, and the charging control agent, the kneaded product is then solidified by cooling and ground, and thereafter size control such as classification or the like is carried out according to need, so that toner particles are obtained.

The blending is preferably dry blending. It is possible to use, as a mixer, a publicly-known mixing device which is commonly used in the technical field. Examples of the mixer include Henschel type mixers such as Henschel mixer (trade name, manufactured by Mitsui Mining Co., Ltd.), Super mixer (trade name, manufactured by Kawata Mfg. Co., Ltd.), Mechanomil (trade name, manufactured by Okada Seiko Co., Ltd.), and the like; and mixers such as Ongmil (trade name, manufactured by Hosokawa Micron Group), Hybridization system (trade name, manufactured by Nara Machinery Co., Ltd.), Cosmo System (trade name, manufactured by Kawasaki Heavy Industries, Ltd), and the like.

It is possible to use, as a kneader, a publicly-known kneading device which is commonly used in the technical field. For example, the kneader is exemplified by general kneaders such as a twin screw kneader, a three-roll mill, a laboratory blast mill, and the like. Specific examples of the kneader include TEM-100B (trade name, manufactured by Toshiba Machine Co., Ltd.); single screw or twin screw extruders such as PCM-65/87 and PCM-30 (trade names, manufactured by Ikegai Corp.), and the like; and open roll type kneaders such as Kneadix (trade name, manufactured by Mitsui Mining Co., Ltd.), and the like. Of these kneaders, an open roll type kneader is preferable in terms of the point that the open roll type kneader is strong in shearing action during kneading and can highly disperse a coloring material such as a pigment, the release agent, and the like.

It is possible to use, as a grinder, a publicly-known grinding device which is commonly used in the technical field. Examples of the grinder include a jet type grinder which carries out grinding by use of a supersonic jet stream and an impact type grinder which carries out grinding by introducing a solidified product into a space formed between a rotator (rotor) which rotates at a high speed and a stator (liner).

It is possible to use, for classification, a publicly-known classification device which is commonly used in the technical field. In particular, it is possible to use a classifier such as a rotary air classifier which can remove overpulverized toner matrix particles by centrifugal force and wind force. Note that the toner to which no external additive has been added is particularly referred to as colored resin particles.

(External Additive)

An external additive is added to the toner of the present invention so that (i) the toner of the present invention improves in carrying property and chargeability and (ii) improves in, for example, stirring property with a carrier in a case where the toner is used as a two component developer.

It is possible to use, as the external additive, a publicly-known external additive which is commonly used in the technical field. Examples of the external additive include silica, titanium oxide, and the like. The external additive is preferably an external additive which is surface-treated (treated so as to be hydrophobized) with silicone resin, a silane coupling agent, or the like.

The external additive is blended in an amount preferably of 1 part by weight to 10 parts by weight, and more preferably of 2 parts by weight to 5 parts by weight, with respect to 100 parts by weight of the colored resin particles.

(Carrier)

A toner of the present invention can be used in a form of either a single component developer or a two component developer.

In a case where the toner of the present invention is used in the form of the two component developer, a carrier is further blended with the toner. According to the full-color toner set of the present invention, a full-color developer set of a single component developer is obtained by adding an external additive to colored fine particles of each of the colors, and a full-color developer set of a two component developer is obtained by adding, to colored fine particles of each of the colors, an external additive and a ferrite carrier coated with a resin.

It is possible to use, as the "carrier", a publicly-known carrier. Examples of the carrier include a single or composite ferrite carrier containing iron, copper, zinc, nickel, cobalt, manganese, chrome, and/or the like, a resin coated carrier obtained by surface-coating carrier core particles with a coating substance, a resin dispersion type carrier obtained by dispersing magnetic particles into a resin, and the like.

It is possible to use, as the "coating substance", a publicly-known coating substance. Examples of the coating substance include polytetrafluoroethylene, a monochlorotrifluoroethylene polymer, polyvinylidene fluoride, silicone resin, polyester resin, a metallic compound of ditertiary butyl salicylic acid, styrene resin, acrylic resin, polyamide, polyvinyl butyral, nigrosine, aminoacrylate resin, basic dye, basic dye lake, silica fine powder, alumina fine powder, and the like. A resin for use in the resin dispersion type carrier is exemplified by, but not limited to styrene acrylic resin, polyester resin, fluororesin, phenol resin, and the like. Any of the resins is preferably selected in accordance with toner components. The resins may be used alone by one kind or as a combination of two or more kinds.

The carrier preferably has a spherical or flat shape. A volume average particle size of the carrier is not particularly limited. In view of an improvement in image quality, the carrier preferably has a volume average particle size preferably of 10 μm to 100 μm, and more preferably of 20 μm to 50 μm. Further, the carrier has a volume resistivity preferably of not less than $10^8$ Ω·cm, and more preferably of not less than $10^{12}$ Ω·cm.

A volume resistivity of the carrier is a value obtained from an electric current value obtained by, after filling carrier particles into a container having a cross section of 0.50 $cm^2$ and tapping the carrier particles, causing the carrier particles filled into the container to be under a load of 1 $kg/cm^2$, and applying a voltage which causes an electric field of 1000 V/cm between the load and a bottom electrode. In a case where the carrier has a low resistivity, the carrier is charged when a bias voltage is applied to a development sleeve, so that the carrier particles easily adhere to a photoreceptor. Further, a breakdown of a bias voltage easily occurs. The carrier preferably has a saturation magnetization of not less than 40 emu/g and not more than 80 emu/g.

A ratio in which the toner and the carrier are used in the two component developer is not particularly limited, and can be appropriately selected in accordance with respective kinds of the toner and the carrier. For example, in a case where the toner is mixed with a resin coated carrier (having a density of 5 $g/cm^2$ to 8 $g/cm^2$), it is only necessary that the toner be contained in an amount of 2 wt % to 30 wt %, and preferably of 2 wt % to 20 wt % of the whole amount of the developer. Further, a ratio in which the carrier is coated with the toner is preferably 40% to 80%.

A full-color developer set of the present invention which full-color developer set is obtainable by mixing a ferrite carrier coated with a resin with the cyan toner, the magenta toner, and the yellow toner of the full-color toner set of the present invention.

An image forming method of the present invention includes: forming, on photoreceptors, electrostatic latent images corresponding to respective colors of cyan, magenta, and yellow; making the electrostatic latent images visible by use of toners of the respective colors; after transferring obtained toner images of the respective colors to a transfer medium so that the toner images overlap each other, causing a fixing device to fix the toner images of the respective colors; and using the full-color toner set recited in claim 1 or the full-color developer set recited in claim 2.

An image forming apparatus of the present invention includes: photoreceptors on which electrostatic latent images corresponding to respective colors of cyan, magenta, and yellow are formed; and a fixing device which is used to fix toner images that have been obtained by making the electrostatic latent images visible by use of toners of the respective colors and transferred to a transfer medium so that the toner images overlap each other, the image forming apparatus using the full-color toner set recited in claim 1 or the full-color developer set recited in claim 2.

According to the present invention, an image forming method and an image forming apparatus each using a full-color toner set or a full-color developer set of the present invention also fall under the category of the invention.

The present invention is not limited to the description of the embodiments above, but may be altered by a skilled person within the scope of the claims. An embodiment based on a proper combination of technical means disclosed in different embodiments is encompassed in the technical scope of the present invention.

EXAMPLES

The following description specifically discusses the present invention with reference to Examples and Comparative Examples. However, the present invention is not limited by Examples.

Examples and Comparative Examples measured values of physical properties by the following methods.

[Weight Average Molecular Weight Mw of Binder Resin and Release Agent Dispersing Aid Resin]

A number average molecular weight and a weight average molecular weight are found from a chart showing a molecular weight distribution which is obtained by the following method by use of gel permeation chromatography.

(1) Preparation of Sample Solution

A resin is dissolved in tetrahydrofuran so that a resultant solution has a concentration of 0.5 g/100 ml. Next, the solution is filtered by use of a fluorine resin filter (FP-200 manufactured by Sumitomo Electric Industries, Ltd.) having a pore size of 2 μm, and an undissolved component is removed. A sample solution is thus prepared.

(2) Measurement of Molecular Weight Distribution

By use of the following measuring device and the following analytical column, tetrahydrofuran is let flow as a solution at a flow rate of 1 ml per minute, and the column is stabilized in a thermostat at 40° C. Measurement is carried out by pouring 100 μl of the sample solution into the solution. A molecular weight of a sample is calculated based on a calibration curve prepared in advance. The calibration curve in this case is prepared using several kinds of mono disperse polystyrene as standard samples.

Measuring device: CO-8010 (manufactured by TOSOH CORPORATION)

Analytical column: GMHXL+G3000HXL (manufactured by TOSOH CORPORATION)

[Softening Point Tm of Binder Resin and Release Agent Dispersing Aid Resin]

By use of a rheological characterization device (Flow Tester (model number: CFT-100C) manufactured by Shimadzu Corporation), a load of 20 kgf/cm$^2$ ($9.8\times10^5$Pa) is applied to 1 g of a sample which is being heated at a temperature increase of 6° C./min, and the sample is let flow out of a die (having a nozzle diameter of 1 mm and a length of 1 mm). A temperature at which a half of the sample has flowed out is referred to as a softening point Tm.

[Glass Transition Temperature Tg of Binder Resin and Release Agent Dispersing Aid Resin]

By use of a differential scanning calorimeter (model number: DSC220 manufactured by Seiko Electronic Industry Co., Ltd. (current Seiko Instruments Inc.)) and in conformity with Japan Industrial Standard (JIS) K7121-1987, a DSC curve is measured by heating 1 g of a sample at a temperature increase rate of 10° C./min. According to the obtained DSC curve, a temperature at an intersection of (i) a straight line obtained by extending a high-temperature side base line of an endothermic peak to a low-temperature side, the endothermic peak corresponding to a glass transition and (ii) a tangent extending from a point where the tangent is the steepest to a curve extending from a rising part to a vertex of the endothermic peak is referred to as a glass transition temperature Tg.

[Melting Point of Release Agent]

By use of a differential scanning calorimeter (model number: DSC220 manufactured by Seiko Electronic Industry Co., Ltd. (current Seiko Instruments Inc.)), a DSC curve is measured by heating 1 g of a sample from a temperature of 20° C. to 200° C. at a temperature increase rate of 10° C./min and carrying out, two times, an operation in which the sample is rapidly cooled from 200° C. to 20° C. A temperature of an endothermic peak corresponding to melting on the DSC curve which is measured at the second time of the operation is regarded as a melting point of the release agent.

[Resistivity of Binder Resin, Release Agent Dispersing Aid Resin, and Toner]

A sample was molded into a pellet by use of a pressing machine, and a resistivity was measured in an environment at a temperature of 25° C. and a humidity of 50%. The measurement was carried out by use of a TR-10C type dielectric loss measurement device manufactured by Ando Electric Co., Ltd., a TO-19 type constant-temperature oven manufactured by Ando Electric Co., Ltd., a BDA-9 type equilibrium position detector manufactured by Ando Electric Co., Ltd., and a WBG-9 type oscillator manufactured by Ando Electric Co., Ltd.

Example 1

Binder resin: 100 parts by weight (for each color) of polyester resin A (having Tg of 63° C., Tm of 122° C., Mw of $5.8\times10^4$, and a resistivity of 265 (Ω·cm))

Coloring agent: 4 parts by weight of each of cyan (C.I. Pigment Blue 15:3), magenta (PR-269), and yellow (PY-74)

Release agent: 5 parts by weight (for each color) of release agent (trade name: WEP-9, manufactured by NOF CORPORATION, and having a melting point of 79° C.)

Charging control agent: 2 parts by weight (for each color) of boron compound (trade name: LR-147, manufactured by Japan Carlit Co., Ltd.)

Release agent dispersing agent: 9 parts by weight (for each color) of styrene acrylic copolymer resin A (trade name: SA800, manufactured by Mitsui Chemicals, Inc., and having Tm of 140° C., Tg of 60° C., and Mw of 49000)

The above raw materials of a toner for one color, e.g., cyan were premixed for 10 minutes by use of Henschel mixer, and then a melt kneading dispersion treatment was carried out with respect to the premixed raw materials by use of a kneading dispersion treatment apparatus (Kneadix MOS100-800 manufactured by Mitsui Mining Co., Ltd.), so that a kneaded product was obtained.

The obtained melt-kneaded product was roughly ground by use of a cutting mill and then finely ground by use of a jet grinder (IDS-2-type manufactured by Nippon Pneumatic Mfg. Co., Ltd.). Further, the melt-kneaded product was classified by use of an air classifier (MP-250-type manufactured by Nippon Pneumatic Mfg. Co., Ltd.), so that cyan colored resin particles were obtained.

Example 1 obtained magenta colored resin particles and yellow colored resin particles as in the case of the obtainment of the cyan colored resin particles except that Example 1 changed the coloring agent.

Next, 1.9 part by weight of silica serving as an external additive was added to 100 parts by weight of the obtained colored resin particles of each of cyan, magenta, and yellow, and a resultant mixture was stirred for 2 minutes by use of an airflow mixer (Henschel mixer manufactured by Mitsui Mining Co., Ltd.) in which a tip speed of a stirring blade was set to 15 m/sec, so that a toner set of Example 1 was prepared. The obtained toner set had a sum of resistivities of $440\times10^9$ (Ω·cm) (C:M:Y=37:206:197).

Example 2

Example 2 prepared a toner set of Example 2 as in the case of Example 1 except that Example 2 added 12 parts by weight of the styrene acrylic copolymer resin serving as the release agent dispersing agent. The obtained toner set had a sum of resistivities of $460\times10^9$ (Ω·cm) (C:M:Y=40:207:213).

Example 3

Example 3 prepared a toner set of Example 3 as in the case of Example 1 except that Example 3 used, as the binder resin, polyester resin B (having Tg of 62° C., Tm of 122° C., Mw of $6.2\times10^4$, and a resistivity of 297 (Ω·cm)) instead of the polyester resin A. The obtained toner set had a sum of resistivities of $472\times10^9$ (Ω·cm) (C:M:Y=42:216:214).

Example 4

Example 4 prepared a toner set of Example 4 as in the case of Example 1 except that Example 4 used, as the binder resin, the polyester resin B identical to that used in Example 3 and that Example 4 added 12 parts by weight of the styrene acrylic copolymer resin serving as the release agent dispersing agent. The obtained toner set had a sum of resistivities of $498\times10^9$ (Ω·cm) (C:M:Y=44:224:230).

Comparative Example 1

Comparative Example 1 prepared a toner set of Comparative Example 1 as in the case of Example 1 except that Comparative Example 1 used, as the binder resin, the styrene acrylic copolymer resin serving as the release agent dispersing agent. The obtained toner set had a sum of resistivities of $1316\times10^9$ (Ω·cm) (C:M:Y=110:619:587).

Comparative Example 2

Comparative Example 2 prepared a toner set of Example 2 as in the case of Example 1 except that Comparative Example 2 did not use the styrene acrylic copolymer resin serving as the release agent dispersing agent. The obtained toner set had a sum of resistivities of $390\times10^9$ (Ω·cm) (C:M:Y=35:175:180).

Comparative Example 3

Comparative Example 3 prepared a toner set of Comparative Example 3 as in the case of Example 1 except that Comparative Example 3 added 2 parts by weight of the styrene acrylic copolymer resin serving as the release agent dispersing agent. The obtained toner set had a sum of resistivities of $401\times10^9$ (Ω·cm) (C:M:Y=33:192:176).

Comparative Example 4

Comparative Example 4 prepared a toner set of Comparative Example 4 as in the case of Example 1 except that Comparative Example 4 used, as the binder resin, polyester resin C (having Tg of 67° C., Tm of 125° C., Mw of $5.8\times10^4$, and a resistivity of 490 (Ω·cm)) instead of the polyester resin A and that Comparative Example 4 added 12 parts by weight of the styrene acrylic copolymer resin serving as the release agent dispersing agent. The obtained toner set had a sum of resistivities of $648\times10^9$ (Ω·cm) (C:M:Y=55:291:302).

Comparative Example 5

Comparative Example 5 prepared a toner set of Comparative Example 5 as in the case of Example 1 except that Comparative Example 5 added 5 parts by weight of the styrene acrylic copolymer resin serving as the release agent dispersing agent. The obtained toner set had a sum of resistivities of $423\times10^9$ (Ω·cm) (C:M:Y=36:203:184).

Comparative Example 6

Comparative Example 6 prepared a toner set of Comparative Example 6 as in the case of Example 1 except that Comparative Example 6 added 17 parts by weight of the styrene acrylic copolymer resin serving as the release agent dispersing agent. The obtained toner set had a sum of resistivities of $500\times10^9$ (Ω·cm) (C:M:Y=43:235:222).

(Preparation of Two Component Developer)

Full-color developer toner sets of two component developers were prepared by mixing carriers and the respective toners of the toner sets as prepared above in Examples 1 through 4 and Comparative Examples 1 through 6. A ferrite core carrier, which was used as each of the carriers, had a volume average particle size of 40 μm and a surface provided with a layer covered with thermosetting straight silicone resin. A developer set was obtained by preparing a two component developer of each of the colors by adding 100 parts by weight of the carrier to 12 parts by weight of the toner of each of the colors, feeding a resultant mixture into a V-shaped mixer (trade name: WELL MIX BLENDER, manufactured by TOKUJU CORPORATION), and stir-mixing the mixture for 40 minutes.

Table 1 shows results of evaluations of charging characteristics of each of the toner sets, toner scattering of each of the developer sets, and presence or absence of photographic fog together with a comprehensive evaluation. The evaluations of charging characteristics, toner scattering, and photographic fog, and the comprehensive evaluation were carried out as below. First, the evaluations of charging characteristics, toner scattering, and photographic fog were carried out. Then, the two component developer which was evaluated as G (Good) for all the items was evaluated as G (Good) in the comprehensive evaluation.

[Charging Characteristics]

After the carriers and the toners of the respective colors of the toner sets prepared in Examples 1 through 4 and Comparative Examples 1 through 6 were subjected to humidity control for not less than 24 hours in an HH environment (at a temperature of 30° C. and a humidity of 85%), the toners and the carriers were measured in a container of 50 ml so that a toner density was 7.5%. Then, the toners and the carriers were triboelectrically charged while the container was being rotated at a rotation rate of 128 rpm. After the rotation was carried out for 1 hour, charged amounts were measured by the following method.

Q=CV was found by pouring a stirred developer into an electromagnetically shielded metallic housing, covering the housing with a metallic mesh, and then sucking toner through the mesh. Q/M [μC/g] was calculated based on Q=CV by measuring an electromotive voltage V at both ends of a known C (electrostatic capacitor C in a measuring machine). A similar action was carried out in an LL environment (at a temperature of 5° C. and a humidity of 10%). In a case where a result obtained by subtracting [charged amount at HH] from [charged amount at LL] was less than 10 μC/g, charged amounts of the toners were evaluated as G (Good). Meanwhile, in a case where a result obtained by the subtraction was not less than 10 μC/g, charged amounts of the toners were evaluated as P (Poor).

G (Good): less than 10 μC/g

P (Poor): not less than 10 μC/g

[Toner Scattering]

A durability test was carried out with respect to the prepared two component developers by use of an image forming apparatus (digital full-color multifunction printer: MX-5001FN manufactured by Sharp Corporation). As developing conditions of the image forming apparatus, a peripheral velocity of a photoreceptor was set to 400 mm/s, a peripheral velocity of a developing roller was set to 560 mm/s, and a gap between the photoreceptor and the developing roller was set to 0.5 mm, and a surface potential and a developing bias of the photoreceptor were adjusted so that toner adhered to paper in a solid image (having a density of 100%) in an amount of 0.5 mg/cm$^2$ and toner adhered to a non-image part in the smallest amount. A test was carried out in an environment at a temperature of 5° C. and a humidity of 10% (LL environment). An A4 sheet of electrophotographic paper (trade name: MULTI RECEIVER, manufactured by Sharp Document Systems Corporation) was used as a test paper.

Images were printed on 50K (fifty thousand) sheets of paper so that a printing rate was 5%, and toner scattering on a cover of a developing tank after the end of the printing of the 50K sheets of paper was visually evaluated.

G (Good): Toner scattering can be seen but is limited.

E (Enough): Toner scattering can be seen and is limited, but occurs in a large amount.

P (Poor): Toner is scattering all over the developing tank.

[Photographic Fog]

A durability test was carried out with respect to the prepared two component developers by use of an image forming apparatus (digital full-color multifunction printer: MX-5001FN manufactured by Sharp Corporation). As developing conditions of the image forming apparatus, a peripheral velocity of a photoreceptor was set to 400 mm/s, a peripheral velocity of a developing roller was set to 560 mm/s, and a gap between the photoreceptor and the developing roller was set to 0.5 mm, and a surface potential and a developing bias of the photoreceptor were adjusted so that toner adhered to paper in a solid image (having a density of 100%) in an amount of 0.5 mg/cm$^2$ and toner adhered to a non-image part in the smallest amount. A test was carried out in an environment at a temperature of 30° C. and a humidity of 85% (HH environment). An A4 sheet of electrophotographic paper (trade name: MULTI RECEIVER, manufactured by Sharp Document Systems Corporation) was used as a test paper.

Images were printed on 50K (fifty thousand) sheets of paper so that a printing rate was 5%, and a color image was printed after the end of the printing of the 50K sheets of paper. Then, a density of a non-image area (having a density of 0%) was measured by the following method, and the density was calculated as photographic fog. A degree of whiteness W1 of paper which had not been subjected to the printing and a degree of whiteness W2 of a non-image area of the paper which had been subjected to the printing were measured by use of COLOR METER manufactured by NIPPON DENSHOKU INDUSTRIES CO., LTD., and a difference in degree of whiteness between W1 and W2 (W1-W2) was found as photographic fog. Photographic fog was evaluated in a color mode. Photographic fog which was less than 1.5 was evaluated as G (Good), and photographic fog which was not less than 1.5 was evaluated as P (Poor).

G (Good): less than 1.5

P (Poor): not less than 1.5

TABLE 1

| | Binder resin (100 pbw) | Styrene acrylic copolymer resin | Sum of resistivities (Ω · m) | Charging characteristics | Toner scattering | Photographic fog | Comprehensive evaluation |
|---|---|---|---|---|---|---|---|
| Ex. 1 | Polyester Resin A | 9 pbw | $440 \times 10^9$ | G | G | G | G |
| Ex. 2 | Polyester Resin A | 12 pbw | $460 \times 10^9$ | G | G | G | G |
| Ex. 3 | Polyester Resin B | 9 pbw | $472 \times 10^9$ | G | G | G | G |
| Ex. 4 | Polyester Resin B | 12 pbw | $498 \times 10^9$ | G | G | G | G |
| Comp. Ex. 1 | Styrene acrylic copolymer resin | 9 pbw | $1316 \times 10^9$ | P | P | G | P |
| Comp. Ex. 2 | Polyester Resin A | | $390 \times 10^9$ | P | E | P | P |
| Comp. Ex. 3 | Polyester Resin A | 2 pbw | $401 \times 10^9$ | P | E | P | P |
| Comp. Ex. 4 | Polyester Resin C | 12 pbw | $648 \times 10^9$ | P | P | G | P |
| Comp. Ex. 5 | Polyester Resin A | 5 pbw | $423 \times 10^9$ | P | G | P | P |
| Comp. Ex. 6 | Polyester Resin A | 17 pbw | $500 \times 10^9$ | G | E | G | P |

"Ex." stands for Example.

"Comp. Ex." stands for Comparative Example.

"pbw" stands for parts by weight.

For the toner sets of Examples 1 through 4, there was no problem with all the items of charging characteristics, toner scattering, and photographic fog, and a favorable result was obtained.

In contrast, in Comparative Example 1, in which not the polyester resin but the styrene acrylic copolymer resin was used as the binder resin, the sum of the resistivities was extremely high beyond a specified range. Therefore, Comparative Example 1 was poor in charging characteristics. Further, in Comparative Example 1, overcharging occurred due to overcharging in an LL environment, and toner scattering also occurred.

Meanwhile, in Comparative Example 2, in which the styrene acrylic copolymer resin serving as the release agent dispersing aid was not contained, the polyester resin had high moisture absorbency. Therefore, Comparative Example 2 showed a clear tendency to be vulnerable to an HH environment and was less charged in the HH environment. Comparative Example 2 was poor in charging characteristics, and photographic fog also occurred in Comparative Example 2. Further, in Comparative Example 2, toner scattering which was limited but occurred in a large amount was also seen in an LL environment.

In Comparative Example 3, in which the styrene acrylic copolymer resin serving as the release agent dispersing aid was contained in an amount falling below a specified amount, an obtained result was identical to that of Comparative Example 2, in which the styrene acrylic copolymer resin was not contained.

In Comparative Example 4, which was identical to Example 1 in contained amount of the styrene acrylic copolymer resin, and which used the polyester resin C having a higher resistivity than the polyester resin A of Example 1, the sum of the resistivities was high beyond a specified range. Therefore, as in the case of Comparative Example 1, Comparative Example 4 was poor in charging characteristics. Further, in Comparative Example 4, overcharging occurred due to overcharging in an LL environment, and toner scattering occurred.

In Comparative Example 5, which had a resistivity falling within a specified range but was small in added amount of the styrene acrylic copolymer resin, moisture absorbency did not improve, and photographic fog occurred in an HH environment. In Comparative Example 6, which had a resistivity falling within a specified range but was large in added amount of the styrene acrylic copolymer resin, charging was high, and toner scattering occurred.

REFERENCE SIGNS LIST

100 Image forming apparatus
114 Developing device

The invention claimed is:

1. A full-color toner set comprising:

a cyan toner; a magenta toner; and a yellow toner each containing a binder resin; a coloring agent; a charging control agent; a release agent; and a release agent dispersing aid, the binder resin being polyester resin, the release agent dispersing aid being styrene acrylic copolymer resin having at least one of an α-methylstyrene structure and a styrene structure, the release agent dispersing aid being contained in an amount of 7 parts by weight to 14 parts by weight with respect to 100 parts by weight of the polyester resin, and the full-color toner set having a sum of resistivities of the cyan toner, the magenta toner, and the yellow toner of $410\times10^9$ to $510\times10^9$ (Ω·cm).

2. A full-color developer set obtainable by mixing a ferrite carrier coated with a resin with the cyan toner, the magenta toner, and the yellow toner of the full-color toner set recited in claim 1.

3. An image forming method comprising:

forming, on photoreceptors, electrostatic latent images corresponding to respective colors of cyan, magenta, and yellow;

making the electrostatic latent images visible by use of toners of the respective colors;

after transferring obtained toner images of the respective colors to a transfer medium so that the toner images overlap each other, causing a fixing device to fix the toner images of the respective colors; and using the full-color toner set recited in claim 1.

4. An image forming apparatus comprising:

photoreceptors on which electrostatic latent images corresponding to respective colors of cyan, magenta, and yellow are formed; and a fixing device which is used to fix toner images that have been obtained by making the electrostatic latent images visible by use of toners of the respective colors and transferred to a transfer medium so that the toner images overlap each other, the image forming apparatus using the full-color toner set recited in claim 1.

* * * * *